US006286871B1

(12) United States Patent
Spector et al.

(10) Patent No.: US 6,286,871 B1
(45) Date of Patent: Sep. 11, 2001

(54) PADS OF EMBOSSED, SELF-STICK PAPER AND PROCESS AND APPARATUS FOR MAKING SAME

(75) Inventors: Gary C. Spector, Portland; Anthony Beaulieu, North Plains, both of OR (US)

(73) Assignee: Carol Wilson Fine Arts, Inc., Portland, OR (US)

( * ) Notice: Subject to any disclaimer, the term of this patent is extended or adjusted under 35 U.S.C. 154(b) by 0 days.

(21) Appl. No.: 09/310,783

(22) Filed: May 12, 1999

Related U.S. Application Data

(60) Provisional application No. 60/085,126, filed on May 12, 1998.

(51) Int. Cl.[7] ..... B42D 15/00; B32B 7/14; B32B 7/06; B32B 7/12

(52) U.S. Cl. ..... 281/15.1; 428/40.9; 281/5; 281/2; 283/67; 283/81

(58) Field of Search ..... 428/40.9; 281/5, 281/2, 15.1; 283/67, 81

(56) References Cited

U.S. PATENT DOCUMENTS

| | | | | |
|---|---|---|---|---|
| 3,332,829 | | 7/1967 | Avery . | |
| 3,508,754 | | 4/1970 | Shorin . | |
| 3,524,782 | | 8/1970 | Bushe . | |
| 4,157,410 | | 6/1979 | McClintock | 428/40 |
| 4,264,388 | | 4/1981 | McClintock | 156/152 |
| 4,281,762 | | 8/1981 | Hatterner | 206/390 |
| 4,460,634 | | 7/1984 | Hasegawa . | |
| 4,760,790 | | 8/1988 | Birkett . | |
| 4,768,810 | | 9/1988 | Mertens . | |
| 4,895,746 | | 1/1990 | Mertens . | |
| 5,050,909 | | 9/1991 | Mertens et al. . | |
| 5,143,404 | | 9/1992 | Flowers | 231/21.1 |
| 5,153,041 | * | 10/1992 | Clements et al. | 428/40 |
| 5,154,962 | | 10/1992 | Mertens et al. | 428/40 |
| 5,158,380 | | 10/1992 | Hauslaib et al. . | |
| 5,382,055 | | 1/1995 | Mertens et al. . | |
| 5,618,062 | | 4/1997 | Mertens et al. . | |
| 5,641,550 | * | 6/1997 | Berman et al. | 281/2 |

* cited by examiner

*Primary Examiner*—A. L. Wellington
*Assistant Examiner*—Mark Henderson
(74) *Attorney, Agent, or Firm*—Klarquist Sparkman Campbell Leigh & Whinston, LLP

(57) ABSTRACT

A continuous process and apparatus are disclosed for applying an adhesive coating to one surface and a release coating to an opposite surface of sheets of previously embossed and optionally decoratively printed paper, and for drying the sheets and then stacking them for processing into individual pads of embossed, self-stick, removable sheets of notepaper. Individual sheets of embossed paper are fed onto a conveyor system, and the feed and conveyor speeds are regulated so that the sheets are in slightly overlapping relationship to form an artificial web as the sheets pass continuously through release coating and adhesive coating subassemblies which continuously apply release and adhesive coatings to opposite sides of the web. Conveyor speeds downstream of the coating subassemblies are regulated to separate the web into its individual coated and embossed sheets as they pass through a dryer. A relatively high-speed stacking conveyor downstream of the dryer delivers the dried sheets one-at-a-time into a stacker where the sheets are stacked and removed to other apparatus for collating with backing sheets, cutting and trimming into multiple note pads of embossed self-stick paper.

13 Claims, 4 Drawing Sheets

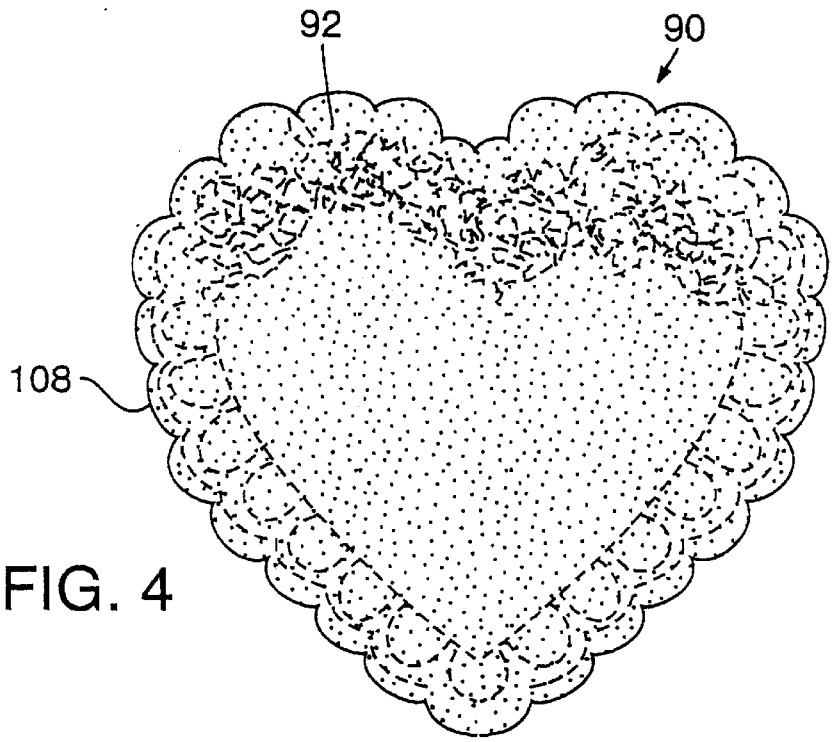
FIG. 4
FIG. 5A Overlap at Feed Table
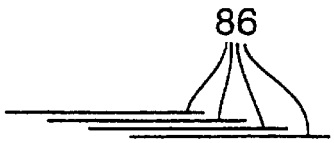
FIG. 5B Overlap at First Transfer Table
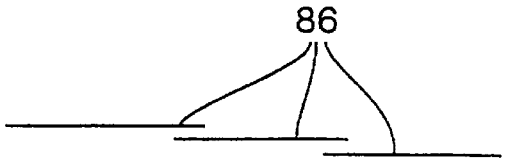
FIG. 5C Overlap at Release-Agent and Adhesive Application Subassemblies
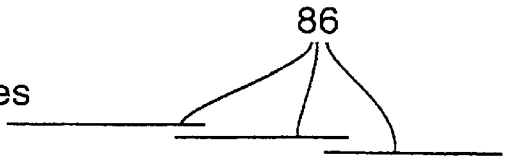
FIG. 5D Dryer Apparatus Advances Sheets to Individual Sheets
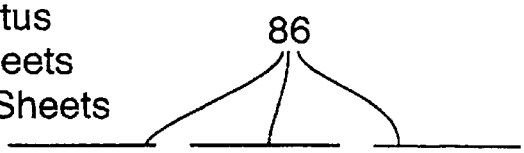

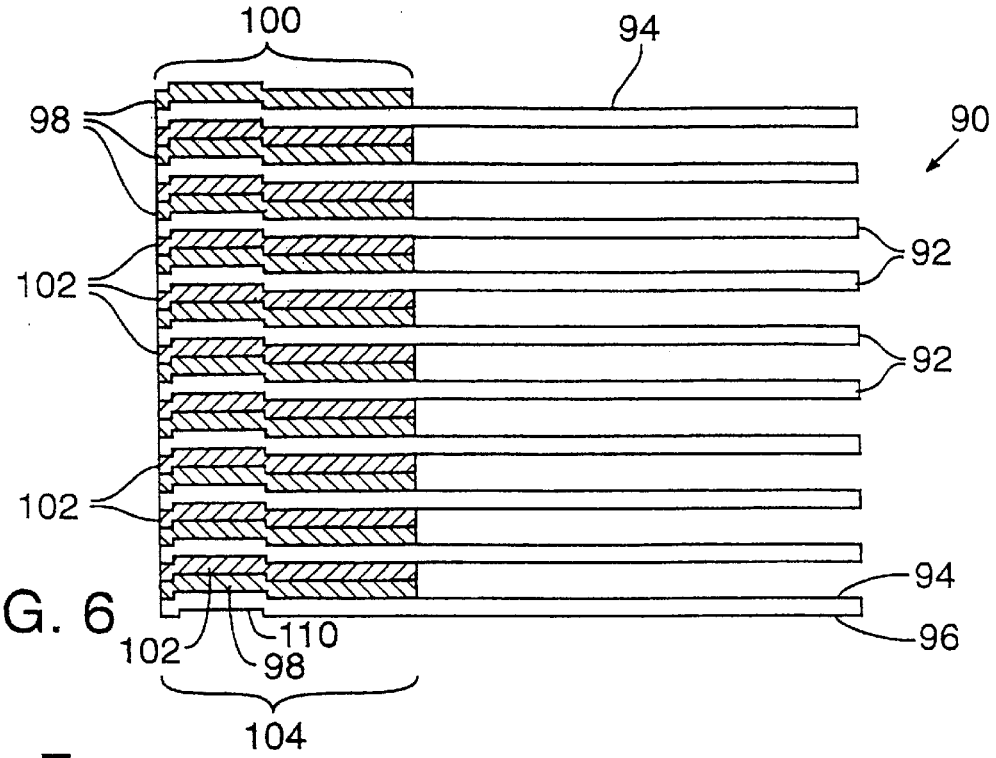
FIG. 6
FIG. 7
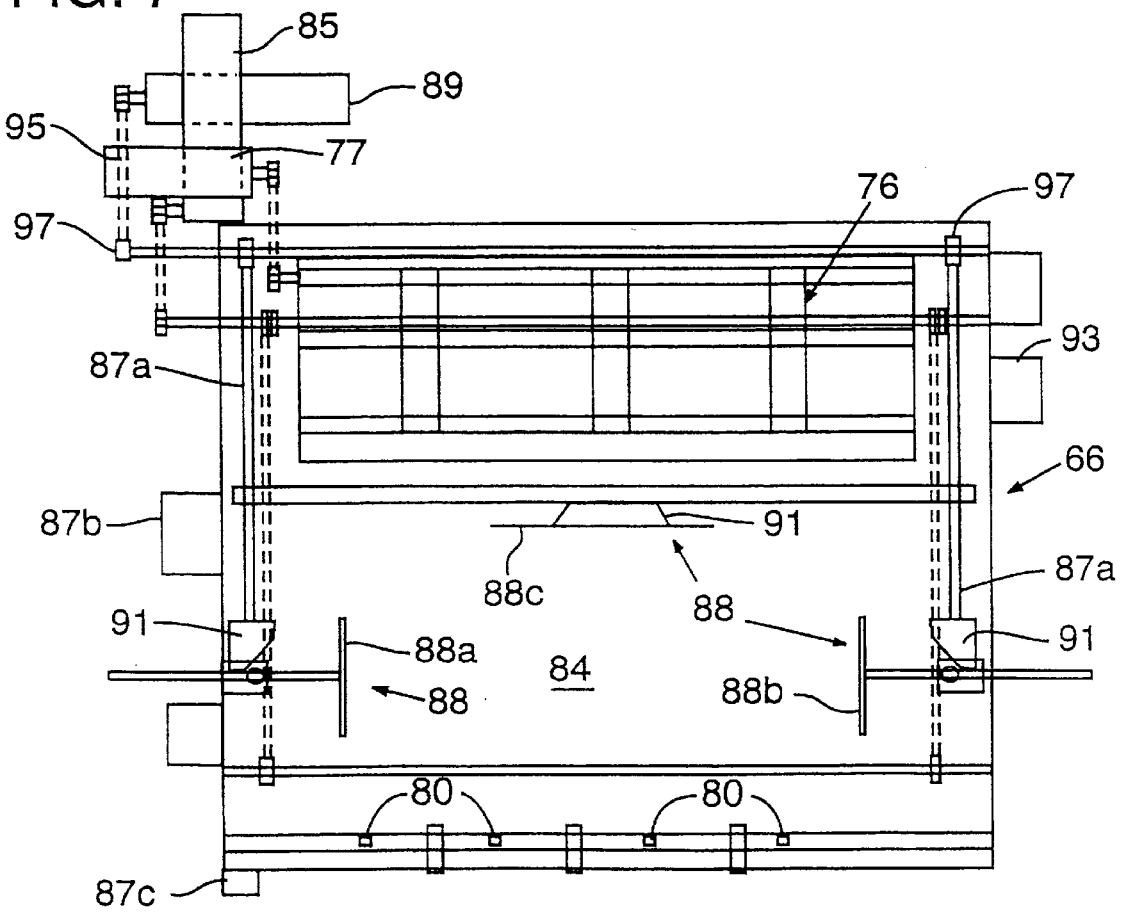

PADS OF EMBOSSED, SELF-STICK PAPER AND PROCESS AND APPARATUS FOR MAKING SAME

REFERENCE TO PRIOR APPLICATION

This application claims the benefit of U.S. Provisional Application, Ser. No. 60/085,126, filed May 12, 1998. This provisional application was entitled PROCESS AND APPARATUS FOR MAKING PADS OF EMBOSSED, SELF-STICK REMOVABLE PAPER, and has the same inventors as this application.

BACKGROUND OF THE INVENTION

1. Field of the Invention

The present invention relates to pads of embossed, self-stick, removable paper and processes and apparatus for making the same.

2. Description of the Prior Art

Note pads made up of stacks of self-stick, removable sheets of notepaper that can be removed from the pad one sheet at a time and applied to various surfaces for use as reminder notes or for sending messages to others have been commonly used for many years in business, industry and in households. Such pads of self-stick notepaper come in various colors. However, other than the variety of colors in which such pads are available, they are, for the most part, made up of plain, non-decorative notepaper.

Applicants have envisioned that it would be desirable to provide pads of self-stick notepaper that are considerably more decorative than those currently available. In particular, they have envisioned providing pads of self-stick decoratively embossed notepaper. However, they have determined that currently available methods and apparatus for manufacturing pads of self-stick, removable paper cannot be used for making such pads of embossed self-stick removable paper.

Conventionally, to form a note pad of self-stick, removable notepaper, an apparatus comprising a web-fed press is used. A web-fed press is designed to accept paper in a continuous sheet from rolls rather than in individual sheets. It is considered necessary to provide a continuous feed (i.e., web-feed) of paper so that adhesive may be applied to the sheet in a continuous manner. Continuous application of the adhesive is preferred to provide an adhesive coating of uniform width and thickness to the sheet. Typically, following application of the adhesive and a release agent, the continuous sheet is cut into individual sheets, which are then stacked and cut into pads.

Available methods for embossing a continuous sheet of paper such as in a web-fed press using an embossing roll are problematic. If embossing of good depth, quality and accuracy of registration with other elements of a design on a sheet are desired, individual sheets of paper must be embossed. Also, the individual sheets must be embossed prior to application of adhesive and/or a release agent. Consequently, pads of embossed, self-stick removable paper as envisioned by the present invention cannot be made using a conventional web-fed press. However, a conventional sheet-fed press, wherein individual sheets of paper are transported separately through the apparatus, cannot be utilized to form the embossed, self-stick pads of paper of the present invention because such sheet-fed presses are not capable of applying adhesive to the individual sheets in a continuous manner so as to insure uniformity of application of the adhesive coating and release agent to each individual sheet.

Accordingly, there is a need not only for pads of embossed self-stick notepaper that are more decorative than currently available pads of self-stick paper, there is also a need for a method and apparatus for making such pads of embossed, self-stick paper.

SUMMARY OF THE INVENTION

Primary objects of the invention are to:

Provide pads of removable, self-stick notepaper, the individual sheets of which are embossed, and printed if desired; and Provide a low-cost, fast and accurate method and apparatus for manufacturing the aforesaid notepads.

More specific objects include the provision of a method and apparatus for making pads of embossed sheets of self-stick paper that have coatings of self-stick adhesive and release agent that are of uniform thickness and width, and uniformly positioned on the sheets.

A further specific object is to provide a method and apparatus as aforesaid in which a coating of self-stick adhesive and/or release agent may be applied accurately to embossed portions or any other desired portions, of the sheets.

The pad of embossed self-stick paper may be made by embossing, and decoratively printing if desired, relatively large sheets of paper. The embossed sheets are fed singly by a sheet feeder onto a conveyor at a speed such that the sheets overlap one another to define an artificial continuous web of paper. The amount of overlap may be adjusted to be minimal before the web is conveyed through a release agent applicator and an adhesive applicator where selected zones on opposite sides of the web are continuously coated, one side with adhesive and the opposite side with release agent. The web proceeds from the applicators into a dryer where a dryer conveyor, operating at a faster speed than the preceding conveyor, separates the web into individual sheets. From the dryer, the sheets proceed onto an overdrive conveyor which delivers each sheet separately at a high rate of speed into a stacker above the upper level of previously stacked sheets. Rails guide each sheet into the stacker, and back and side joggers jog the newly delivered sheet into alignment with previously stacked sheets as the newly delivered sheet descends onto the top of the stack. Front stops within the stacking chamber assist in aligning the sheets in the stack. The stacker also includes a hoist that can be lowered to lower the upper level of the stack as the stack builds up so as to maintain a desired clearance between each newly delivered embossed and adhesive-coated sheet and the top of the stack.

The foregoing and other objects, features and advantages of the present invention will be more apparent from the following detailed description which proceeds with reference to the accompanying drawings.

DESCRIPTION OF THE DRAWINGS

In the drawings,

FIG. 4 is a view of the front face of an embossed sheet of notepaper of the pad of notepaper of the invention, made in accordance with the process and apparatus of the invention;

FIGS. 5A–D are diagrams illustrating, progressively, the relationship between individual sheets of embossed paper as the sheets are processed in accordance with the present invention; and FIG. 6 is a schematic side elevational view, on a very enlarged scale, of a pad of releasable, self-stick, embossed sheets of paper in accordance with the invention and made with the method and apparatus of the invention.

FIG. 7 is a schematic top plan view of the stacker portion of the apparatus shown in FIG. 1.

DETAILED DESCRIPTION OF A PREFERRED EMBODIMENT

Figure 1:
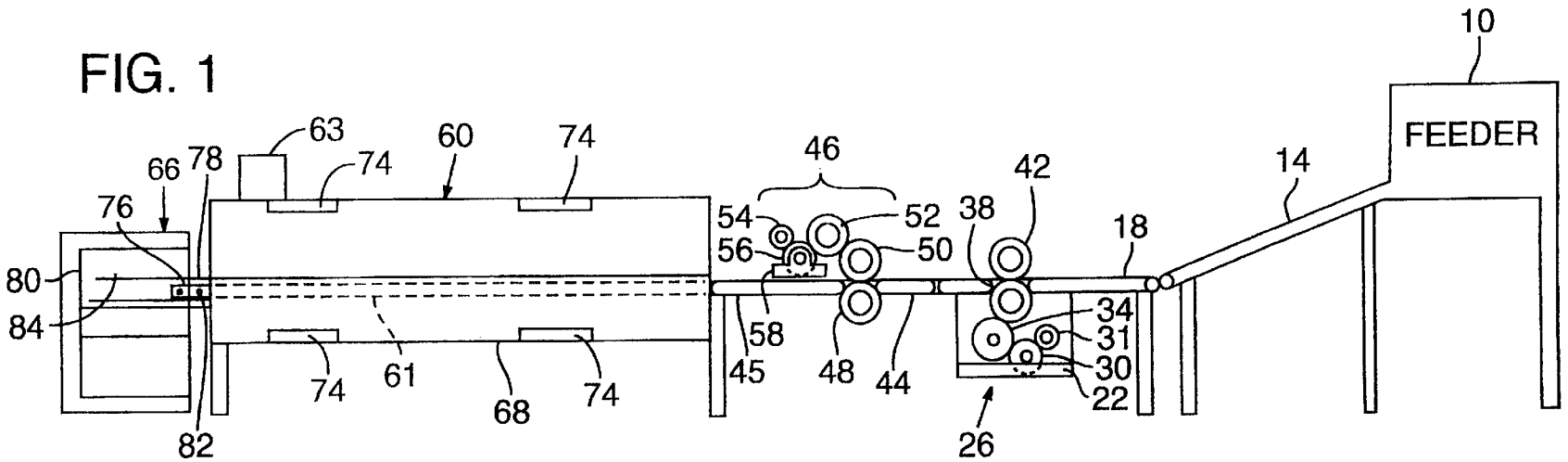
FIG. 1 is a schematic elevational view of an apparatus for manufacturing pads of self-stick embossed sheets of paper in accordance with the invention.

Referring to FIGS. 4 and 6, the pad 90 of the present invention comprises sheets 92 of individually embossed paper arranged in a stack. Each sheet 92 of paper includes a major upper surface 94 and an opposite, major lower surface 96. Each sheet of paper further includes at least a band 98 of release-agent coating, preferably located on a first edge zone 100 on the upper surface 94. A narrow band of pressure-sensitive adhesive 102 is coated on a second edge zone 104 on the lower surface of each sheet of paper, wherein the second edge zone opposes the first edge zone. The sheets 92 of paper are stacked such that the second edge zone 104 on the lower surface of one sheet contacts the first edge zone 100 on the upper surface of an adjacent lower sheet of paper. The adhesive and release coatings of each sheet of paper allow removable attachment of the sheet to adjacent sheets or to other surfaces, such as walls, desktops, and counter tops. At least a portion of each sheet is embossed and may include additional decorative indicia, such as art work (e.g., reproductions of watercolor paintings) printed on selected portions of the upper surfaces of the sheets. The pads of paper may further be decoratively die cut along predetermined lines, such as marginal edges 108 as shown in FIG. 4, to form custom printed pads. The embossing on each sheet may be in or extend into or throughout the adhesive and release-agent coated zones such as embossed border 110 in FIG. 6. Preferably, the raised portions of the embossing extend from the upper surfaces of the sheets, where any decorative printing will usually also appear, as shown in FIG. 4.

FIG. 1 shows, schematically, the hybrid continuous feed apparatus and related elements used in manufacturing and assembling the sheets of embossed, preprinted paper used to form the pads of embossed, self-stick paper described with reference to FIGS. 4 and 6. In sequence, beginning at the right-hand side of FIG. 1, and proceeding in a downstream direction, such apparatus includes a sheet feeder 10, a sheet feed table 14, and a first sheet transfer table 18. Table 18 transfers sheets into a release agent subassembly 26 for applying a release agent to one surface of the sheets. A second transfer table 44 transfers the sheets from the release agent subassembly into an adhesive applicator subassembly 46 for applying pressure-sensitive adhesive to an opposite surface of the sheets. From the adhesive applicator, a third transfer table 45 delivers the sheets onto a dryer conveyor 61 within a dryer housing unit 60. Downstream of the dryer, an overdrive conveyor 76 delivers the dried sheets one-at-a-time at high speed into a sheet stacker 66 where the sheets are stacked and vertically aligned. After stacking, the sheets are removed from the stacker, collated with backing sheets, cut into strip pads, and finally die cut into single pads in a hydraulic press. The collating and cutting steps are not shown but are performed in apparatus separate from the continuous feeder-release applicator-adhesive applicator-dryer-stacker shown and described. Such collators and die cutters are well known in the field of manufacturing paper products, including pads of paper.

Referring again to FIG. 1, the individual paper sheet feeder 10, such as used with printing presses, is connected to a standard feed table 14 for feeding individual sheets of paper separately thereto. Feed table 14 comprises any transport system suitable for transferring separate sheets of paper, and preferably comprises a conveyor belt driven by a variable-speed DC motor (not shown). The first transfer table 18 is positioned downstream of and immediately adjacent to the feed table 14 for receiving sheets of paper therefrom. The transfer table 18 comprises any transport system suitable for transferring sheets of paper, and, like the feed table 14, preferably comprises a conveyor belt system driven by a DC variable-speed motor (not shown).

Release-agent subassembly 26 is located immediately downstream of the first transfer table 18 for application of release agent to the major upper surface of embossed sheets of paper, which, however, face downward as they travel through the described apparatus. The release-agent subassembly 26 includes a release-agent tray 22, a release-agent dip roller 30, a release-agent metering roller 34, a doctor roller 31, a first segmented-application roller 38, and a first impression roller 42. The release-agent tray holds a known release agent to be applied to the sheets of paper. The release-agent dip roller 30, preferably comprising a standard rubber roller, is positioned so that its lower portion rolls in the release agent in the release-agent tray to pick up agent from the tray. The doctor roller 31 is positioned upstream and immediately adjacent the dip roller 30 for removing excess release agent from the dip roller 30. The release-agent metering roller 34 is sized and positioned to receive release agent from the release-agent dip roller 30 after the doctor roller 31 has removed excess release agent from the dip roller. Accordingly, the release-agent metering roller 34 is positioned to contact the release-agent dip roller 30, and is preferably positioned immediately adjacent to and slightly above the release-agent dip roller. In turn, the first segmented-application roller 38 is positioned to contact the release-agent metering roller 34, and is preferably positioned immediately adjacent to and substantially above the release-agent metering roller.

Although the release-agent metering roller 34 may comprise any conventional type metering roller, the release-agent metering roller 34 preferably comprises a stainless-steel rod closely wound with stainless-steel wire. The wire-wound release-agent metering roller 34 operates to regulate the amount of release agent that is delivered to the first segmented-application roller 38, and thus, the amount of release agent that is delivered from the first segmented application roller 38 to each sheet of paper.

Figure 2:
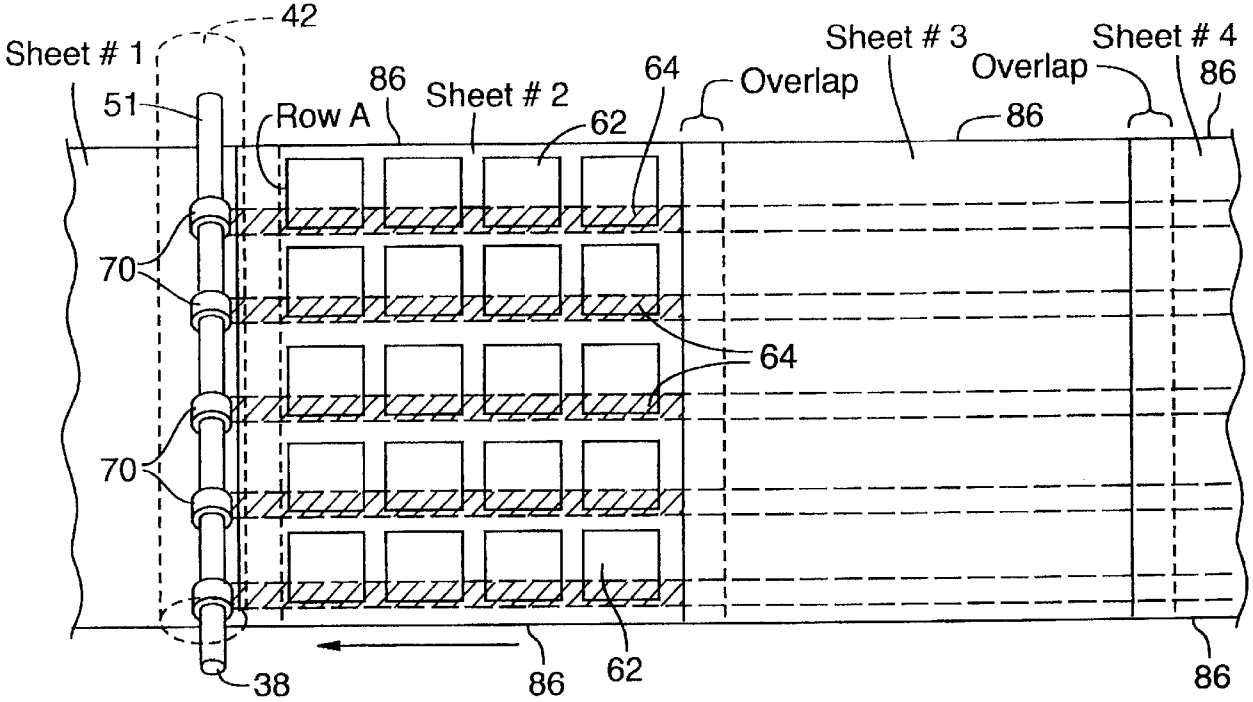
FIG. 2 is a schematic perspective view of a portion of the release agent subassembly of the apparatus of FIG. 1 as viewed from below the subassembly and showing several overlapping sheets of paper being processed at the subassembly.

Referring to FIG. 2, the first segmented-application roller 38 comprises a shaft 51 mounting multiple rolls 70. The rolls 70 preferably comprise standard rubber application rolls. The size of rolls 70 may be varied, and the placement of rolls 70 is adjustable along shaft 51, such that the release agent may be placed in various locations and may cover various portions of the upper surface (facing downwardly in the assembly) of the sheet of paper. For example, viewing sheet no. 2 in FIG. 2, strips 64 illustrate the locations of preferred edge zone portions of the sheet whereon release agent will be applied in continuous strips by corresponding rollers 70.

Referring back to FIG. 1, the first segmented-application roller 38 is positioned to contact the sheets of paper as they are fed through the hybrid-feed apparatus of the present invention. The first impression roller 42 is positioned above and adjacent to the sheets of paper, directly above the first segmented-application roller 38 such that, as the sheets of paper are fed through the subassembly between the first segmented-application roller 38 and the first impression roller 42, pressure is applied to both the upper surface and the lower surface of the sheet of paper. The first impression roller 42 preferably comprises a solid rubber roller, but may comprise any roller suitable for applying pressure to the sheets of paper in opposition to the application roller as the release agent is applied thereto by the first segmented-application roller.

The release-agent dip roller 30, the doctor roller 31, and the release-agent metering roller 34 are independently driven by a variable-speed DC motor. Accordingly, the thickness of the release-agent coating applied to the sheet of paper may be varied by varying the speed of such rollers. The first segmented-application roller 38 and the first impression roller 42 are both driven by the movement of the first transfer table 18, and thus convey the sheets at the same speed as the first transfer table.

The second transfer table 44 is positioned immediately downstream of the release-agent subassembly 26 for receiving the sheets of paper therefrom and delivering the sheets of paper to an adhesive-application subassembly 46. The second transfer table is preferably driven by a variable-speed DC motor (not shown). Alternatively, the second transfer table 44 may be driven by the same motor that drives the first transfer table 18. Second table 44 is driven at the same speed as first transfer table 18.

The adhesive-application subassembly 46 comprises an adhesive tray 58, an adhesive-dip roller 56, a doctor roller 54, an adhesive-regulator roller 52, a second segmented-application roller 50, and a second impression roller 48.

The adhesive tray 58 holds adhesive to be applied to the sheets of paper. The adhesive-dip roller 56, preferably comprising a standard rubber roller, is positioned to roll in the adhesive solution in the adhesive tray 58. The doctor roller 54 is positioned downstream of and immediately adjacent to the adhesive-dip roller 56 to remove excess adhesive therefrom. The adhesive-regulator roller 52 is sized and positioned to receive adhesive from the adhesive-dip roller 56 after excess adhesive has been removed from the adhesive-dip roller 56 by the doctor roller 54. Accordingly, the adhesive-regulator roller 52 is positioned to contact the adhesive-dip roller 56, and is preferably positioned immediately adjacent to and slightly above the adhesive-dip roller 56. In turn, the second segmented-application roller 50 is positioned to contact the adhesive-regulator roller 52, and is preferably positioned immediately adjacent to and substantially above the adhesive-regulator roller.

Although the adhesive-regulator roller 52 may comprise any conventional type metering roller, the adhesive-regulator roller preferably comprises a stainless-steel rod wound with stainless-steel wire. The wire-wound adhesive-regulator roller 52 operates to regulate the amount of adhesive that is delivered to the second segmented-application roller 50, and thus, the amount of adhesive that is delivered from the second segmented-application roller 50 to each sheet of paper.

Referring to FIG. 2, the second segmented-application roller 50, like the first segmented-application roller 38 comprises a shaft 51 having multiple rollers 70. The rollers 70 preferably comprise standard rubber application rollers. Both the size and the placement of the rollers 70 are adjustable such that the adhesive may be placed in various locations and may cover various portions of the upper surface of the sheet of paper.

The second segmented-application roller 50 is positioned to contact the upwardly facing lower surface of the sheets of paper as they are fed through the hybrid-feed apparatus of the present invention. The second impression roller 48 is positioned below and adjacent to the sheets of paper, directly below the second segmented-application roller 50 such that, as the sheets of paper are fed through the apparatus between the second segmented-application roller 50 and the second impression roller 48, pressure is applied to both the upper surface and the lower surface of the sheet of paper. The second impression roller 48 preferably comprises a solid rubber roller, but may comprise any roller suitable for applying pressure to the sheets of paper as the adhesive is applied thereto by the second segmented-application roller 50.

The adhesive-dip roller 56, the doctor roller 54, and the adhesive-regulator roller 52 are independently driven by a variable-speed DC motor. Accordingly, the thickness at which the adhesive is applied to the sheet of paper may be varied by varying the speed of such rollers. The second segmented-application roller 50 and the second impression roller 48 are both driven by the movement of the second transfer table 44, and thus convey the sheets at the same speed as the first and second transfer tables.

The third transfer table 45, driven at the same speed as the first and second transfer tables, conveys the paper sheets from the adhesive application subassembly 46 into a dryer 60. Together, these three transfer tables comprise a constant-speed conveyor system for moving the continuous web of sheets into and from the release-agent and adhesive applicator subassemblies.

Dryer 60, comprising a conveyor 61, a housing 68, and a vent 63, is positioned downstream of and adjacent to the third transfer table 45 and downstream of the adhesive-application subassembly 46. The third transfer table 45 delivers to the conveyor 61 of the dryer 60 overlapped sheets of paper having both a release-agent coating on the upper (downwardly facing) surface and an adhesive coating on the lower (upwardly facing) surface thereof. The conveyor 61 (preferably about 20 feet in length) is independently driven by a variable-speed DC motor (not shown) at a faster speed than the transfer tables to separate the overlapped sheets of paper received from the third transfer table 45, as illustrated in FIGS. 5A–D. The individual sheets of paper are then moved along the dryer conveyor 61 to travel through the dryer housing 68 for drying both the release agent and adhesive coatings on the sheets of paper.

The vent 63 provided in the housing 68 releases excess heat. The interior of the housing 68 of dryer 60 may be heated in any manner suitable for causing the evaporation of any excess moisture in the adhesive and release agent coatings without damaging the sheets of paper or coatings thereon. The interior of the housing 68 is preferably heated using multiple 230 volt finned tubular heating elements 74. Air is preferably blown over all four heating elements 74 shown using 115 volt, 264 c.f.m. fans (not shown) having restrictor plates to allow for the reduction of air flow as necessary.

Continuing to refer to FIG. 1 and also to FIG. 7, overdrive conveyor section 76 is positioned downstream of and immediately adjacent to dryer conveyor 61, outside of housing 68. The overdrive section 76 transfers, at relatively high speed, the individual sheets delivered from the dryer conveyor 61 to a stacker assembly 66. The stacker assembly 66 includes guide rails 78, delivery stops 80, adjustable wire guides 82, a jogger 88 (FIG. 7), and a delivery or stacking square 84. The overdrive section 76 is preferably driven independently of the other conveyors by a variable-speed DC motor and chain drive 77. The guide rails 78 function to direct the sheets of paper toward the delivery stops 80, ensuring complete delivery to the delivery square 84. The adjustable wire guides 82 are positioned under the sheet path to further aid in the straight delivery of the sheets of paper to the delivery square 84. The jogger vibrates the sheets of paper as they are delivered to the delivery square 84 to jog each sheet into alignment with the stack of previously delivered and stacked sheets. The jogger is preferably controlled by a variable-speed DC motor 89. The jogging speed of the jogger may thus be regulated as necessary to fine tune the alignment of the delivered sheet for accurate stacking. In general, the jogger is operated at a substantially higher speed than joggers associated with conventional printing press stackers because of the problems associated with stacking adhesive-coated sheets and the importance of having exact alignment of the embossed sheets for forming the pads before a sheet is added to the stack.

A delivery hoist or lift, shown partially in FIG. 7, allows an operator to selectively lower a stack of paper within the delivery square 84 as the delivery square fills. The delivery hoist preferably comprises a four-chain hoist controlled by a variable-speed DC motor 85. It includes the lift connecting chains 87*a*, the lift control box 87*b* and lift pulley 87*c*.

EXAMPLE

In a working embodiment of the apparatus of the invention, a printing press feeder was used as feeder 10. Elements of the release agent subassembly had the following specifications. Dip roller 30 was a rubber roller with a 4-inch outer diameter. The doctor roller 31 was an aluminum roller having a 2-inch outer diameter, and the release agent applicator roller 34 was a stainless steel roll having a 4-inch outer diameter and wire-wound with 0.014 inch stainless steel wire. The applicator roll 38 had rubber applicator segments (rolls) 70 each with an outside diameter of 6 inches and a length of 1¾ inches. The impression roller 42 was a rubber roll having a 6inch outside diameter.

The dimensions and construction of the principal elements of the adhesive applicator subassembly 46 were the same as the corresponding elements of the release agent subassembly except that the stainless steel, wire-wound regulator roller 50 of the adhesive applicator subassembly was wound with 0.016 inch diameter stainless steel wire.

It has been found to be important that the surfaces of the dip and impression rollers of the two subassemblies be parallel and true with respect to their respective contacting rollers for accurate, even transfer of the adhesive and release agent to the surfaces of the application rolls and from the application rolls to the artificial web. For this purpose, the dip and impression rollers were over-bored with respect to their shafts and provided with set screws for adjusting the roller surfaces relative to their shafts. In this way the surfaces of these rollers can be trued to the surfaces of their contacting rollers for uniform transfer of adhesive or release agent throughout each revolution of the rollers.

The stacker 66 is a modified printing press stacker. In conventional printing press stackers, gripper bars grip and carry each sheet to the stack, with minimal jogging of the sheet as it is deposited on the stack. However, because the embossed, adhesive-coated sheets used to form the pads must be precisely aligned, with raised (positive) embossing of one sheet nesting within the depressed (negative) embossing of the adjacent sheet in the stack, and further because the adhesive-coated and embossed sheets generate too much friction to be precisely stacked if delivered in sliding contact with the top sheet in the stack, conventional stacking methods cannot be used. In stacker 66, the overdrive conveyor 76, controlled by speed controller 79, delivers each sheet at high speed between the guide rails into the stacking square 84 and slightly above the upper limits of the side jogging plates 88*a* and 88*b* and back jogging plate 88*c*, and two to three inches above the top of the stack within the stacking square. The delivered sheet strikes the front stops 80 within the stacking chamber and descends between the joggers 88. As the sheet descends, the joggers, driven together by variable speed jog motor 89 and through jog drive blocks 91, jogs the sheet quite rapidly as the sheet settles onto the stack. This ensures exact nesting of the delivered sheet with the previously stacked and nested sheets. Whereas a sheet may be jogged once or twice as it is stacked in a conventional printing press stacker, the embossed sheets are preferably jogged four to six times as they settle onto the stack. The jogger speed control 93 controls the jogging speed of all three joggers 88. Jogger linkage 95 and jogger control drive arms 97 deliver power to the jogger drive blocks 91.

A counter (not shown) on the stacker can be used to remove a stack of sheets from the stacker when a predetermined number of sheets have been stacked. A stack can be removed as additional sheets are delivered.

Figure 3:
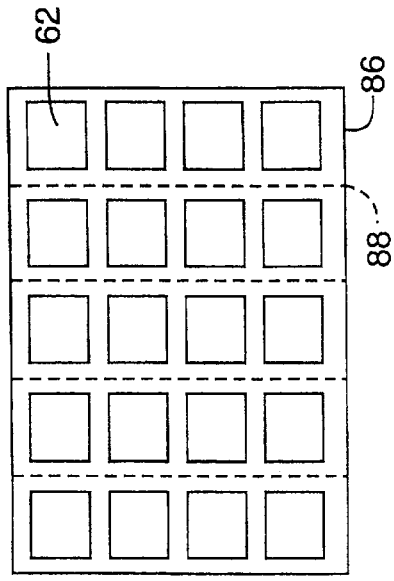
FIG. 3 is a top plan view of a single sheet of paper as processed in accordance with the invention and prior to the sheet being cut into individual sheets of notepaper.

The hybrid-feed process used to manufacture the pads of embossed, self-stick, removable paper of the present invention is described utilizing the hybrid-feed apparatus illustrated in FIG. 1. In general, single sheets of previously embossed and optionally pre-printed paper are loaded upside-down into the feeder 10. Referring to FIG. 3, each individual sheet of paper may comprise multiple paper sections 62 arranged in a grid format. Each paper section 62 will eventually comprise a single sheet in a pad of embossed, self-stick, removable paper (e.g., see FIGS. 4 and 6).

Referring to FIGS. 1, 2, 3, and 5A–D, single sheets 86 of embossed paper are stream fed upside-down from the feeder 10, onto feed table 14 at a speed such that one sheet overlaps the next sheet substantially on feed table 14 to create an artificial web of paper (i.e., a continuous stream of overlapped sheets of paper). The stream of overlapping sheets of paper travel along the feed table 14 to the first transfer table 18. The first transfer table 18 is driven at a slightly faster speed than feed table 14 to reduce the amount of overlap of the sheets of paper to a desired distance (e.g., about 0.5 inches) as shown in FIG. 5B. Because an overlap of adjacent sheets of paper continues, the artificial web is still in place. The artificial web of paper travels along the first transfer table 18 to the release-agent subassembly 26. The release-agent dip roller 30 receives release agent from the release-agent tray 22 and delivers release-agent to the release-agent metering roller 34. The release-agent metering roller 34 regulates the amount of release agent applied to the first segmented-application roller 38. Roller 38 transfers a continuous, uniformly thick coating of release agent in strips of constant width to those sections of the artificial web in contact with the rolls 70 of the first segmented-application roller. Such application is accomplished by the squeezing of the artificial web between the rolls 70 and the first impression roller 42.

Following the application of the release-agent coating to the lower facing upper surface (appears to be lower surface as observed in FIG. 1) of the artificial web of paper, the artificial web continues its travel at the same constant speed along the second transfer table 44 to the adhesive-application subassembly 46 to maintain the slight sheet overlap as shown in FIG. 5C. The adhesive-application subassembly 46 operates in the same manner as described above in relation to the release-agent subassembly 26, to apply a continuous, uniformly thick coating of adhesive to selected portions of the artificial web of paper. These portions are preferably strips of the same width as the strips of release coating and in corresponding positions but on the opposite side of the web.

Following application of the adhesive coating to the lower surface of the artificial web of paper, the artificial web of paper continues its travel along the third transfer table 45 at the same constant speed to the conveyor 61 of dryer 60. The dryer conveyor 61 is operated at a faster speed than the third transfer table 45 such that the artificial web, or continuous stream, of paper is separated into individual sheets of paper as shown in FIG. 5D. The individual sheets of paper travel along conveyor 61 in dryer 60, whereby excess moisture from the adhesive coating and/or release agent coating is evaporated.

The individual sheets are transferred from the conveyor 61 to the stacker assembly 66 at a relatively high speed such that each individual sheet is delivered to the delivery square 84 prior to the arrival of the next sheet of paper. The jogger jogs the paper into place to provide a uniformly aligned stack of embossed, coated paper. The stacks of paper are then removed from the artificial web assembly, and collated with backer sheets. Each stack of embossed, coated paper is then cut along lines 88 into strips to separate rows of paper sections 62 (see FIG. 3). The multiple strips of multiple paper sections 62 are then subdivided by cutting and trimming into individual pads of paper. The pads may then be die cut to create pads of embossed, self-stick removable paper having a decorative-edge shape (e.g., see FIG. 4).

Having illustrated and described what are currently preferred embodiments of the invention, it should be apparent to persons skilled in the art, that the embodiments may be modified in arrangement and detail without departing from the true spirit and scope of the invention as set forth in the following claims.

We claim:

1. A note pad of decorative, self-stick, removable note sheets comprising:

(a) multiple note sheets arranged in a stack having a lowermost note sheet, each sheet including a first sheet surface and an opposite second sheet surface;

(b) each note sheet including a release-agent coating on the first sheet surface and pressure-sensitive adhesive coating on the second sheet surface;

(c) The multiple note sheets being joined together by the adhesive on the second sheet surface of one sheet adhering to the release coating of the first sheet surface of an adjacent sheet;

(d) a backing sheet adhered to the lowermost note sheet of the stack;

(e) each of the note sheets being embossed.

2. The pad of claim 1, wherein a portion of each note sheet with the adhesive coating is embossed.

3. The pad of claim 1, wherein the adhesive coating is on an edge zone of the second sheet surface of each note sheet and wherein the note sheets each include an embossed border that extends into the edge zone.

4. The pad of claim 1, wherein each of said first and second sheet surfaces includes an edge zone, the edge zones being directly opposite one another on the opposing first and second surfaces of the sheet, the release agent coating being at least on the edge zone of the first surface.

5. The pad of claim 4, wherein each of the embossed sheets includes raise embossing in the edge zone of the first sheet surface.

6. A note pad of decorative, self-stick, removable note sheets comprising:

(a) multiple note sheets arranged in a stack, each of the note sheets being embossed;

(b) the embossed note sheets including a release-agent coating on a first sheet surface and a pressure-sensitive adhesive coating on an opposite second sheet surface; and (c) the pressure-sensitive adhesive coating on the second sheet surface of a sheet in the stack being adhered to the release-agent coating on the first sheet surface of an adjacent sheet in the stack to join multiple said embossed note sheets together to form the pad.

7. The pad of claim 6 wherein the embossed sheets of paper include embossed portions and unembossed portions, and wherein the pressure-sensitive adhesive coating and the release-agent coating are applied to unembossed portions of the sheets.

8. The pad of claim 6 wherein the embossed sheets include both embossed and unembossed portions, and wherein the pressure-sensitive adhesive coating and the release-agent coating are applied to embossed portions of the sheets.

9. The pad of claim 6 wherein the pressure-sensitive adhesive coating and release-agent coating are applied to both embossed and unembossed portions of the embossed sheets.

10. The pad of claim 6 wherein an embossed sheet includes an edge zone extending along opposite surfaces of the sheet, the edge zone of one surface including the pressure-sensitive adhesive coating and the edge zone of the opposite surface including the release-agent coating.

11. The pad of claim 6 wherein the embossed sheets include embossed edge zones having die-cut decorative marginal edges.

12. The pad of claim 6 wherein the embossed sheets include printed indicia thereon.

13. The pad of claim 6 wherein the embossed sheets are multiple-color printed and the color printing is in register with embossing on the sheets.

* * * * *

UNITED STATES PATENT AND TRADEMARK OFFICE

CERTIFICATE OF CORRECTION

PATENT NO. : 6,286,871 B1 
DATED : September 11, 2001
INVENTOR(S) : Gary C. Spector and Anthony Beaulieu It is certified that error appears in the above-identified patent and that said Letters Patent is hereby corrected as shown below:

Column 3,
Line 23, "preferably" should be deleted.
Line 27, after "zone." and before "The" insert -- Although the adhesive and release coatings are shown on edge zones of the sheets, they may obviously be applied to any other zones of the sheets. --.

Column 7,
Line 44, "6inch" should be -- 6-inch --.

Signed and Sealed this

Tenth Day of September, 2002

*Attest:*

*Attesting Officer*

JAMES E. ROGAN
*Director of the United States Patent and Trademark Office*